US005895165A

United States Patent [19]

Mogelonsky

[11] Patent Number: 5,895,165

[45] Date of Patent: Apr. 20, 1999

[54] FOLIO POCKET SYSTEM

[75] Inventor: Larry Leibe Mogelonsky, Toronto, Canada

[73] Assignee: Post-Fax Inc., Montreal, Canada

[21] Appl. No.: 08/909,854

[22] Filed: Aug. 12, 1997

Related U.S. Application Data

[60] Provisional application No. 60/030,597, Nov. 13, 1996.

[51] Int. Cl.[6] ..... B42F 13/00

[52] U.S. Cl. ..... 402/79; 402/80 R; 281/31; 281/38; 281/22

[58] Field of Search ..... 281/15.1, 22, 29, 281/31, 33, 34, 35, 36, 37, 38; 402/79, 80 R, 500; 229/72, 67.1; 206/308.3, 232; 40/773, 774, 705, 709; D3/303; D19/26, 32; 283/2, 56, 67, 900, 74, 75

[56] References Cited

U.S. PATENT DOCUMENTS

| | | | |
|---|---|---|---|
| D. 266,172 | 9/1982 | Fraser et al. | D19/26 |
| 2,980,445 | 4/1961 | Sorensen | 281/33 |
| 3,655,119 | 4/1972 | Thompson | 281/31 |
| 4,004,689 | 1/1977 | Glasell | 281/31 |
| 4,051,609 | 10/1977 | Boursaw | 281/30 |
| 4,473,153 | 9/1984 | Colangelo | 206/312 |
| 4,508,366 | 4/1985 | Brindle | 231/36 |
| 4,549,658 | 10/1985 | Sfikas | 206/614 |
| 4,640,413 | 2/1987 | Kaplan et al. | 206/232 |
| 4,765,466 | 8/1988 | Ivey | 206/232 |
| 4,793,477 | 12/1988 | Manning et al. | 206/232 |
| 4,804,133 | 2/1989 | Kiyokane | 446/80 |
| 4,957,205 | 9/1990 | Rose, Jr. | 206/444 |
| 5,042,841 | 8/1991 | Friedman | 281/29 |
| 5,125,561 | 6/1992 | Idstein | 283/116 |
| 5,141,252 | 8/1992 | Michlin | 281/38 |
| 5,199,743 | 4/1993 | Rosinski, III | 402/79 X |
| 5,275,438 | 1/1994 | Struhl | 281/31 |
| 5,288,144 | 2/1994 | Guderyon | 281/31 |
| 5,318,222 | 6/1994 | Bartlett | 229/72 |
| 5,393,157 | 2/1995 | Basmajian | 402/79 |
| 5,507,526 | 4/1996 | Petkovsek | 283/116 |
| 5,579,908 | 12/1996 | Johnson | 281/45 |
| 5,620,271 | 4/1997 | Bergh et al. | 402/79 |
| 5,713,683 | 2/1998 | Bergh et al. | 402/79 |

FOREIGN PATENT DOCUMENTS

| | | | |
|---|---|---|---|
| 1213757 | 10/1958 | France . | |
| 2656307 | 6/1978 | Germany | 281/15 |

*Primary Examiner*—Frances Han
*Attorney, Agent, or Firm*—Virginia H. Meyer, Esq.

[57] ABSTRACT

The present invention provides a new folio pocket system that securely holds inserted supplemental material. The inserted supplemental material, such as a computer diskette or a CD-ROM disk, is held in a pocket created by and between a first sheet and a second sheet attached thereto, where the second sheet has at least one cutout opening therethrough that defines an opening in the pocket through which the supplemental material may be inserted into the pocket. In use, the preventer means and components of the pocket prevent the inserted supplemental material from unintentionally sliding out of the pocket. Additionally, the folio pocket system of the present invention may be included as a part of a folio, binder or report cover system.

20 Claims, 8 Drawing Sheets

FOLIO POCKET SYSTEM

RELATED APPLICATION

This application claims the benefit of U.S. Provisional Application No. 60/030,597 filed Nov. 13, 1996.

FIELD OF THE INVENTION

The present invention relates to folio pocket systems. More specifically, the present invention relates to a new folio pocket system wherein computer diskettes or other supplemental materials are securely held and prevented from sliding out of the folio pocket.

BACKGROUND OF THE INVENTION

The use of folio pockets of different designs and configurations is well known in the prior art. For example, a number of different slit and pouch pocket designs can be found in numerous folios available in any stationary store or catalog.

For example, one common folio pocket design is a simple bottom flap that is integrally formed with a folio cover at the bottom edge. This bottom flap folds up and is coupled to the cover to form the desired pouch pocket for the receipt of papers or other supplemental materials. This prior art pocket, however, does not ensure that the supplemental materials therein will remain in the pocket when the folio is handled by the user or placed in a briefcase or book bag.

Another design known in the art is described in U.S. Pat. No. 4,460,413 to Kaplan et al., who disclose a folder package design wherein the folder has a closed pocket in its rear portion that encapsulates a computer diskette. In the Kaplan design, the folder prevents the diskette from being removed without cutting a slot in the folder. Once a slot is cut, however, the folder no longer prevents the diskette from sliding out of the pocket.

While the folio pockets of the prior art fulfill their respective objectives and requirements, the prior art folio pockets do not describe or suggest a folio pocket system that provides means for securely holding a diskette or other supplemental materials and preventing the inserted diskette or other supplemental materials from sliding out of the pocket. In this respect, the folio pocket system according to the present invention represents a substantial improvement over the concepts and slit pocket designs of the prior art, and in doing so provides a novel folio pocket system primarily developed for the purpose of securely holding supplemental materials in a pocket that includes means for preventing the inserted material(s) from sliding out of the pocket. Therefore, it can be appreciated that a need exists for a new folio pocket system that securely holds supplemental materials in a pocket and prevents the materials from sliding out. In this regard, the present invention substantially fulfills this need.

SUMMARY OF THE INVENTION

The present invention provides a new folio pocket system that securely holds supplemental materials, like a computer diskette, a pad of paper, or a reference card, within the folio. Once the desired supplemental materials are placed in the folio pocket, the components of the pocket system secure the supplemental material(s) and prevent them from accidentally falling out of the folio or report cover system.

The folio pocket system of the present invention comprises a backing sheet, a carrier sheet, and preventer means. The backing sheet and the carrier sheet have at least a first common edge, and at least a second common edge, where the second common edge is opposite the first common edge. The backing sheet and the carrier sheet are joined or joinable to one another at least at these two common and opposite edges, so as to form pocket by and between the backing sheet and the carrier sheet. The carrier sheet has at least one cutout opening therethrough, where the cutout opening defines an opening in the pocket and second of the common/joined edges of the backing sheet and the carrier sheet defines an end of the pocket. According to the invention, the cutout opening is oriented on the carrier sheet such that material inserted therein contacts the pocket end. Also according to the invention, there are preventer means integrated into the second carrier sheet, or in contact with the second carrier sheet, for preventing materials inserted into the pocket, through said cutout opening, from sliding out of the pocket. The preventer means can comprise a cover sheet that is securely attached over the second carrier sheet, or other means, such as a stopper assembly or a cover flap integrated into the second carrier sheet.

The folio pocket system of the present invention may be made of any suitable pliable material, such as paper, paper board, plastic, fabric, leather and the like. (As used herein, "folio" is used generically and inclusively, and is meant to include actual folio systems, folder systems, report systems, binder systems, and the like.)

The folio pocket system of the invention may be square, but preferably is rectangular in shape, with short upper and lower edges, and longer lateral sides. In one preferred form, the upper edge is longer than the lower edge resulting in a folio pocket system with one vertical lateral edge and one angled/sloping lateral edge as a design element. In another embodiment, the upper and lower edges are the same in length, resulting in a rectangular shaped pocket system.

Preferably, the folio pocket system is made from a singe sheet of suitable stock, and then folded into two or three sections, depending on the chosen embodiment, with a first sheet/section of the folio pocket system functioning as a backing sheet. In use, preferably at least the first "backing" sheet is affixed to a report, binder or folio cover system along an inner or binding edge such that the pocket system forms another page or insert in the report. The first "backing" sheet may be secured to the report by any suitable means known in the art, including adhesive, staples, prong fasteners, round head brass fasteners, or binding means, such as a binding comb or velobinders. In one preferred form, when the folio pocket system will be included within a report or folio, and the report or folio will be bound with a binder comb, at least the first "backing" sheet has an array of small rectangular cutouts along the left or inner vertical edge in a binder comb configuration to match the binder comb means of the report or folio cover system.

As indicated above, the folio pocket system of the present invention includes means for preventing inserted supplemental material from sliding out of the pocket. In one preferred form, the preventer means is created when the pocket system is affixed into a report or binder cover system. In this embodiment, the cutout opening is a slit-like opening in the carrier sheet, such that when the report cover system is in a closed orientation, desired content is prevented from sliding out of the pocket by the inner or binding edge of the report cover system. Additionally, the folio pocket system of the present invention may include alternative preventer means. By way of example, the folio pocket system may include a stopper assembly that prevents the inserted materials from sliding out of the pocket. In its simplest form, such a stopper assembly may be one layer of pliable material coupled to the carrier sheet such that the exposed edge of the inserted material rests against an edge of the stopper assembly. In this manner, the inserted material is prevented from sliding out of the pocket. Alternatively, the folio pocket system may include a pocket cover flap that covers the exposed portion of the inserted materials and similarly prevents it from sliding out of the pocket through the cutout opening. With these preventer means, the location of the cutout opening with respect to the inner binding edge is not critical.

The folio pocket system may be provided by the manufacturer as part of a folio, report or binder cover system or may be provided separately for later inclusion. By way of example and in one preferred style, the first sheet of the folio pocket system is formed integrally with the inner or binding edge of a front report cover to form a report cover system with an integrated folio pocket system. Alternatively, if the folio pocket system is provided separately, the user will need to secure or otherwise affix the pocket system to a report cover system by any suitable means. In preferred forms, the folio pocket will have means to facilitate this affixation, such as pre-punched holes corresponding to the binding means of a report or folio cover system. Additionally, when the folio pocket is separate from the report front or back cover, it can be placed at any point within the report, binder or folio cover system.

By way of example and according to one teaching of the invention, the first backing sheet of the folio pocket system has small cutout sections along the vertical lateral edge corresponding to the comb binding means of a report cover system into which the pocket system will be included. Further, the second and opposite lateral edge of the first sheet is integrally formed with a lateral edge of the second sheet to form a first common joining or fold line. The second sheet is folded over the first sheet along the first fold line. The second lateral edge of the second sheet may also have small cutout sections corresponding to the small cutout comb binding sections of the first sheet such that both the first and second sheets are affixed to the report cover at the binding means thereof. The second sheet also has at least one larger slit-like cutout opening therethrough that forms the opening of the folio pocket into which supplemental materials are placed. The larger slit-like cutout opening is oriented such that an edge of the desired supplemental material abuts against the fold line between the first and second sheets and the opposite edge of the desired content remains outside of the pocket. In this manner, the upper and lower edges of the larger cutout opening engage the remaining two sides of the inserted supplemental materials. When the folio pocket system is bound to a report cover system, the inserted supplemental material is prevented from completely sliding out of the pocket by the inner binding edge of the report cover system.

Again by way of example and according to another teaching of the invention, the folio pocket system may be integrally attached to the front cover of a folio or report cover system. Specifically, the lateral vertical edge of the first sheet of the pocket system may be integrally formed with an inner lateral edge of the report front cover. Otherwise, the system is substantially the same as the previous example discussed above.

The more important features of the invention have thus been outlined, rather broadly, so that the detailed description thereof that follows may be better understood, and in order that the present contribution to the art may be better appreciated. Additional features of the invention will be described below.

In this respect, before explaining preferred embodiments of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may be readily utilized as a basis for the designing of other structures, methods and systems for carrying out the several purposes of the present invention. It is important, therefore, that the claims be regarded as including such equivalent constructions insofar as they do not depart from the spirit and scope of the present invention.

OBJECTS OF THE PRESENT INVENTION

It is an object of the present invention to provide a new folio pocket system that provides means for securely holding supplemental materials within a report cover system.

It is another object of the present invention to provide a folio pocket system that has means for preventing inserted supplemental material from sliding out of the pocket.

It is another object of the present invention to provide a new folio pocket system wherein a pocket is created by and between a backing sheet and a carrier sheet attached thereto, wherein the carrier sheet has at least one cutout or slit-like opening therein for the receipt of supplemental materials.

It is another object of the present invention to provide a folio pocket system that is of unitary construction.

Yet another object of the present invention is to provide a new folio pocket system that may be easily and efficiently manufactured.

It is a further object of the present invention to provide a new folio pocket system that is of durable and reliable construction.

It is an even further object of the present invention to provide a new folio pocket system that is susceptible of a low cost of manufacture with regard to both materials and labor, and which accordingly is then susceptible of low prices of sale to the consuming public, thereby making such a folio pocket system economically available to the buying public.

These together with other objects of the present invention, along with the various features of novelty that characterize the invention, are pointed out with particularity in the claims annexed to and forming part of this disclosure. For a better understanding of the invention, its operating advantages and the specific objects attained by its uses, reference should be had to the accompanying drawings and descriptive matter which illustrates preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1A is a plan view of a first preferred embodiment in an unassembled and spread orientation, where the components will ultimately be bound together with a comb binder; FIG. 1B illustrates the features of a slit-like cutout opening in the pocket system of the present invention; FIG. 1C is a front view of a comb bound first preferred embodiment constructed in accordance with the principles of the present invention, wherein a computer diskette has been inserted into the pocket of the present invention; FIG. 1D is a plan view of an alternate first embodiment, where the components will ultimately be bound with round head brass fasteners; FIG. 1E is a plan view of the alternate first embodiment in a partially assembled orientation, where the components will ultimately be bound with round head brass fasteners.

FIG. 2A is a plan view of a second preferred embodiment in a spread orientation; FIG. 2B is a front view of a second preferred embodiment constructed in accordance with the principles of the present invention, and wherein a diskette has been inserted into the pocket.

FIG. 3A is a plan view of a third preferred embodiment in a spread orientation; FIG. 3B is a front view of a third preferred embodiment constructed in accordance with the principles of the present invention; FIG. 3C is a front view of a third preferred embodiment wherein a computer diskette has been inserted into the pocket of the present invention.

FIG. 4A is a plan view of a fourth preferred embodiment in a spread orientation, wherein the folio pocket of the present invention is integrally formed with a front cover of a report or folio system; FIG. 4B is a plan view of a fourth preferred embodiment wherein the report front cover is in an open configuration.

FIG. 5A is a plan view of a fifth preferred embodiment in a spread orientation, wherein two pockets are included in the system; FIG. 5B is a front view of a fifth preferred embodiment constructed in accordance with the principles of the present invention; FIG. 5C is a front view of a fifth preferred embodiment wherein two computer diskettes have been inserted into the pockets of the present invention.

The same reference numerals refer to the same parts throughout the various Figures.

DESCRIPTION OF A FIRST PREFERRED EMBODIMENT

Figures 1A, 1B, 1C:
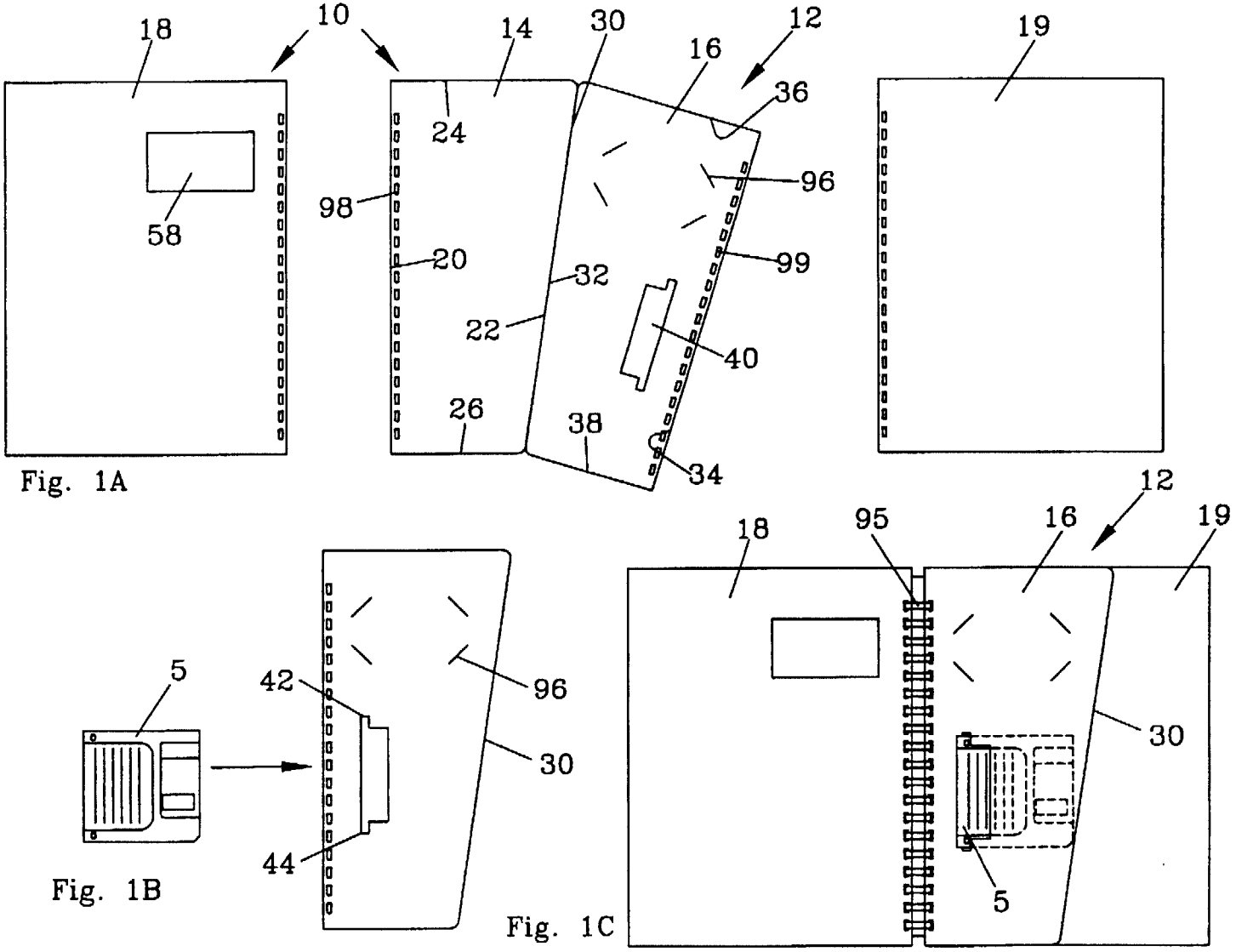
FIGS. 1A–1E.

With reference now to the drawings, and in particular, to FIGS. 1A–1C thereof, a first preferred embodiment of the new folio pocket system embodying the principles and concepts of the present invention and generally designated by the reference number 10 will be described.

Specifically, it will be noted in the various Figures that the invention relates to a folio pocket system for securely holding supplemental materials, such as a computer diskette or other materials. In its broadest context, the invention comprises a first backing sheet, a second carrier sheet having at least one cutout section therein defining an opening to a pocket, and preventer means to hold the inserted material within the pocket. Such components are individually configured and correlated with respect to each other so as to attain the desired objective.

More specifically, in the first preferred embodiment the present invention is a system 10, as shown in FIGS. 1A–1C. System 10 is formed of a slit-like or cutout pocket assembly 12 and a front cover sheet 18. Slit-like pocket assembly 12 comprises a first backing sheet 14 and a second carrier sheet 16. First backing sheet 14 has long vertical side edge 20 and long lateral sloped edge 22. In this preferred form, backing sheet 14 has short upper edge 24 and short lower edge 26. Backing sheet 14 may also have small cutout sections 98 along lateral edge 20 such that system 10 may be bound with a report cover system of a similar configuration.

Next provided in slit-like pocket assembly 12 of this embodiment is the system's second carrier sheet 16. Second carrier sheet 16 is preferably substantially the same shape and size as first backing sheet 14. Second carrier sheet 16 has lateral edges 32 and 34, upper edge 36 and lower edge 38. Second carrier sheet 16 may be formed separately from first backing sheet 14, but in a preferred style is formed integrally with it. Specifically, long lateral edge 32 of second sheet 16 is formed integrally with long sloping edge 22 of first backing sheet 14 along a first common joining or fold line 30. Second carrier sheet 16 also has small cutout sections 99 along lateral edge 34 corresponding to small cutout sections 98 of first backing sheet 14. Second carrier sheet 16 also has cutout opening 40 therein that forms the opening of the slit-like pocket.

Second carrier sheet 16 may also have means for securing a business card or other material thereto. In FIGS. 1A and 1B, the securing means are shown as four slits 96 into which the four corners of a business card may be placed and presented through window 58, when front cover 18 is folded over to cover slit-pocket assembly 12.

To assemble the folio pocket system, second carrier sheet 16 is folded over first backing sheet 14 along first common fold line 30. A standard binding-comb system 95 preferably binds pocket assembly 12 with front cover sheet 18, back cover sheet 19, and the other contents of a folio or report cover system. In this manner, a pocket is created by and between first backing sheet 14 and second carrier sheet 16 with an opening at slit-like cutout section 40 into which supplemental material may be inserted. Referring to FIG. 1C, the binding 95 of the report cover system provides/creates the preventer means by which inserted supplemental material is stopped from sliding completely out of the pocket. As shown in FIG. 1C, the desired supplemental material may be a computer diskette 5. Also shown in FIGS. 1B and 1C, fold line 30 prevents diskette 5 from sliding too far within the pocket and, thus, keeps a portion of diskette 5 outside of the pocket so that upper edge 42 and lower edge 44 of slit-like cutout opening 40 engages opposite sides of diskette 5. This configuration also allows the user to more easily retrieve the diskette. Upper edge 42 and lower edge 44 of slit-like cutout opening 40 prevents diskette 5 from sliding between first backing sheet 14 and second carrier sheet 16 in a vertical direction. Slit-like cutout opening 40 is also located such that when the pocket assembly 12 is bound in a report or folio cover system, the inner or bound edge or binding 95 of the report cover system prevents the diskette from sliding completely out of the pocket. In this manner, diskette 5 is held securely by system 10 and the attached report cover system.

Figure 1D:
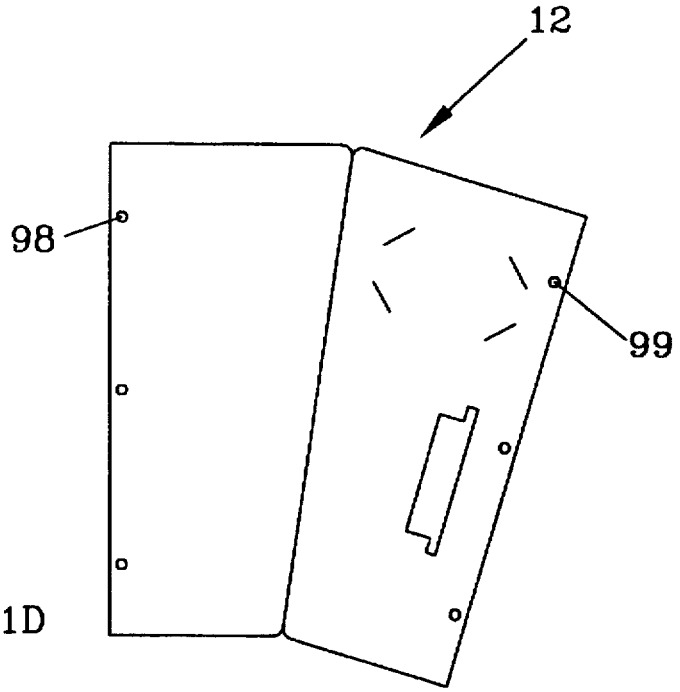
Figure 1E:
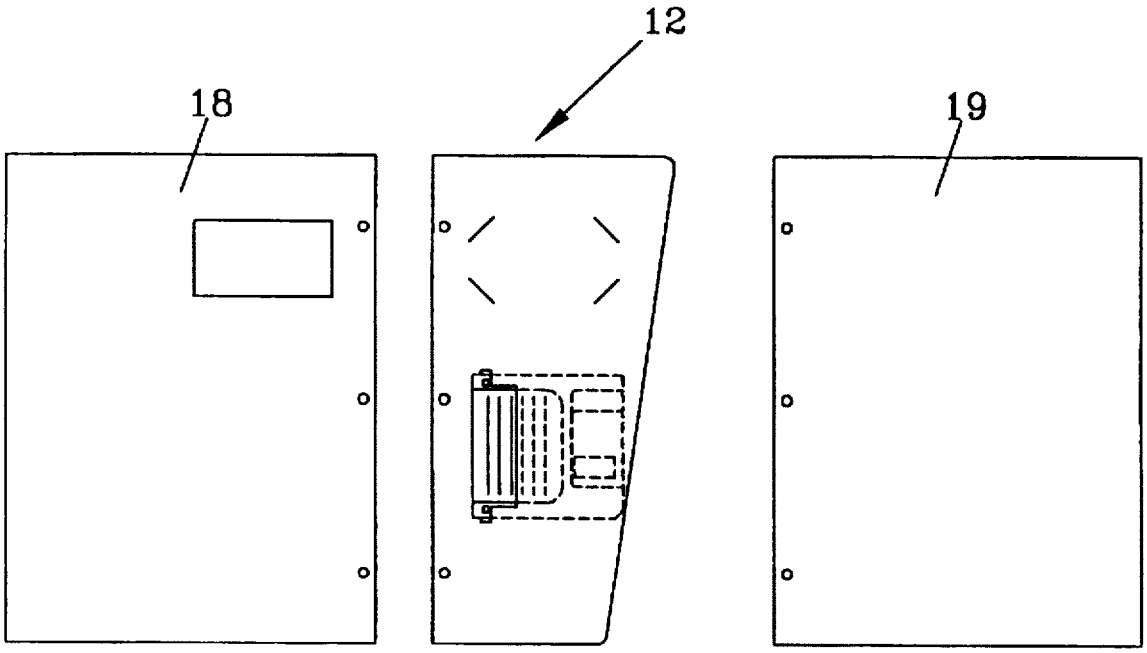

FIGS. 1D and 1E illustrate an alternate form of the first preferred embodiment, where the component parts are ultimately bound into a report or binder system with round head brass fasteners. Otherwise, this alternate form of the first preferred embodiment is substantially identical to the preferred form shown in FIGS. 1A–1C.

DESCRIPTION OF A SECOND PREFERRED EMBODIMENT

Figure 2A:
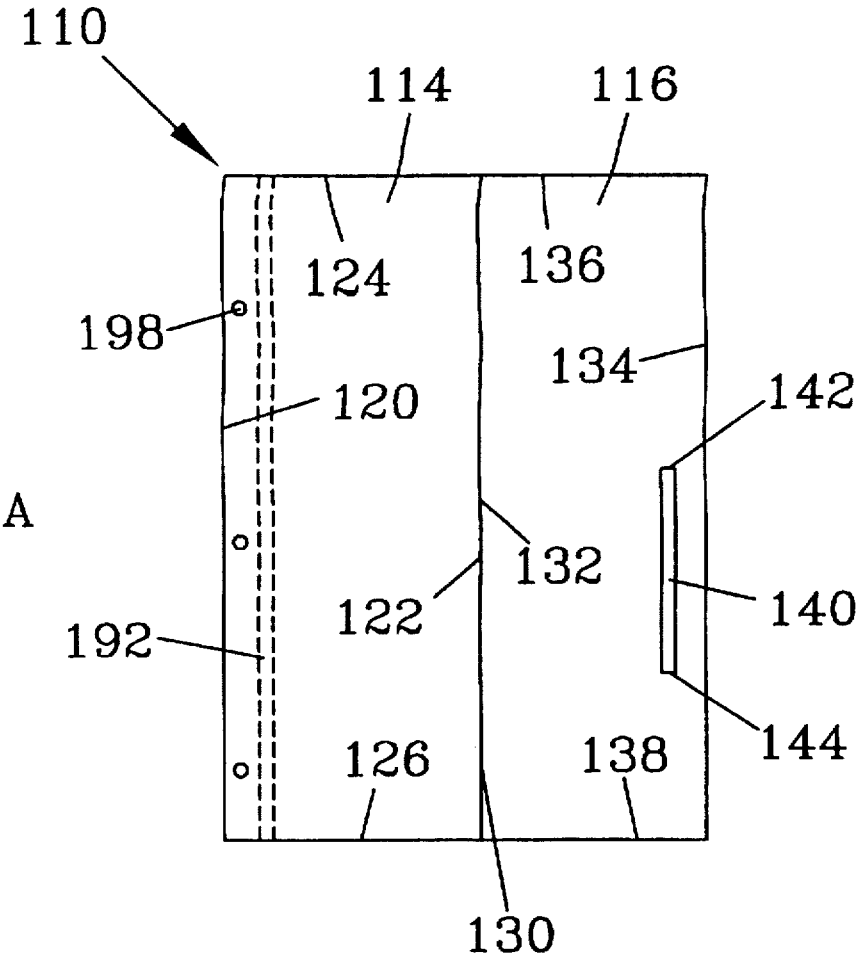
FIGS. 2A and 2B.
Figure 2B:
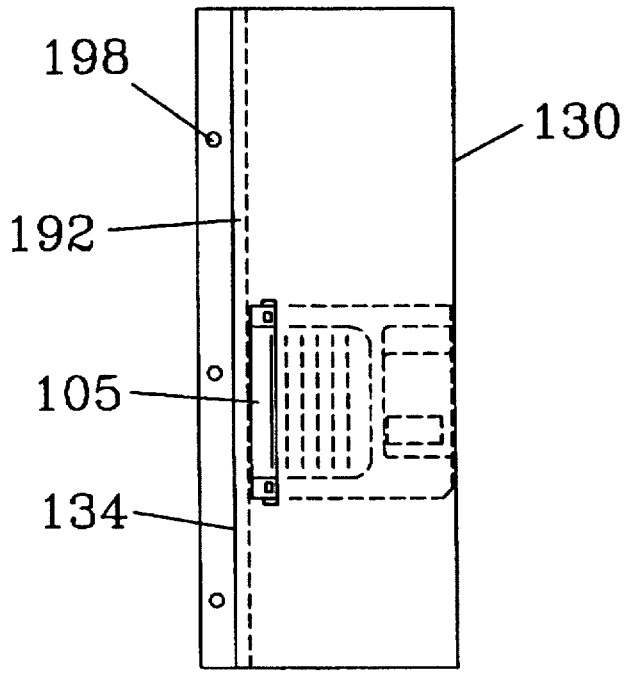

In a second preferred embodiment all of the lateral edges of the pocket assembly of the invention are in a vertical orientation. Additionally, the cutout section in the second carrier sheet that forms the opening of the pocket is a simple narrow rectangular cutout section. In this second embodiment, the second carrier sheet is coupled to the first backing sheet along the lateral edge of the second carrier sheet that is opposite a bindable edge on the first backing sheet to form the pocket of the present invention. Further, the first backing sheet has bindable means comprised of three quarter-inch holes in a three-hole punch configuration. This form of the invention is shown in FIGS. 2A and 2B.

Pocket assembly 110 is again comprised of a first backing sheet 114 and a second carrier sheet 116. First backing sheet 114 has long vertical side edges 120 and 122. Backing sheet 114 also has short upper edge 124 and short lower edge 126. Backing sheet 114 may also have small cutout sections 198 along lateral edge 120 such that system 110 may be bound with a report cover system of similar configuration. In this embodiment, small cutout sections 198 are arranged in a three-hole punch configuration.

Next provided in the pocket assembly of this embodiment is the second carrier sheet 116. Second carrier sheet is preferably substantially the same shape and size as first backing sheet 114. Second carrier sheet 116 has lateral edges 132 and 134, upper edge 136 and lower edge 138. Second carrier sheet 116 may be formed separately from first backing sheet 114, but in a preferred style is formed integrally with it. Specifically, long lateral edge 132 of second sheet 116 is formed integrally with long lateral edge 122 of first backing sheet 114 along a first common joining or fold line 130. Second carrier sheet 116 also has slit-like cutout opening 140 therein that forms the opening of the pocket.

To construct the pocket assembly, second sheet 116 is folded over first backing sheet 114 along first common fold line 130. Adhesive 192 couples lateral edge 134 of second sheet 116 to the inner face of first backing sheet 114. In this manner, a pocket is created by and between first backing sheet 114 and second sheet 116 with an opening at slit-like cutout section 140 into which supplemental material may be inserted. As shown in FIG. 2B, the desired supplemental material may again be a computer diskette 105. Also shown in FIG. 2B, fold line 130 contacts the entire edge of diskette 105 and also prevents diskette 105 from sliding too far within the pocket. Similar to the first preferred embodiment, the diskette is held in at least two additional points; namely, the upper edge 142 and lower edge 144 of slit-like cutout opening 140 prevents diskette 105 from sliding between first sheet 114 and second sheet 116 in a vertical direction. As discussed in the first preferred embodiment, the folio pocket system is formed by binding or otherwise attaching pocket assembly 110 into a folio or report cover system. And again, slit-like cutout opening 140 is also located such that when pocket assembly 110 is bound in a report or folio cover system, the inner edge or binding means of the report cover system prevents the diskette from sliding completely out of the pocket.

DESCRIPTION OF A THIRD PREFERRED EMBODIMENT

Figure 3A:
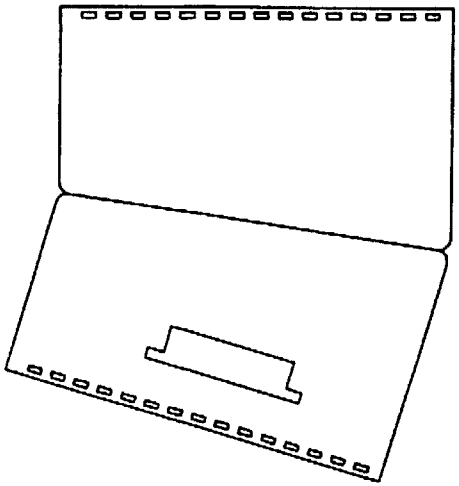
FIGS. 3A, 3B and 3C.
Figure 3B:
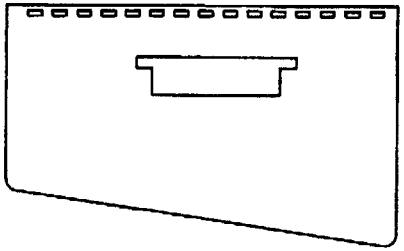
Figure 3C:
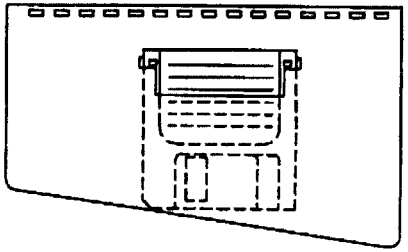

FIGS. 3A and 3B show a third preferred embodiment of the present invention. The third preferred embodiment features a modified pocket assembly that is constructed and assembled in a horizontal configuration as opposed to the vertical configuration of the first and second preferred embodiments. In use, this assembly may be placed into a report cover system that opens in a vertical direction to form a folio pocket system of the present invention. Otherwise, the third preferred embodiment is substantially the same as the first preferred embodiment. Accordingly, reference should be had to the description of the first preferred embodiment as such description will not be repeated herein.

DESCRIPTION OF A FOURTH PREFERRED EMBODIMENT

Figure 4A:
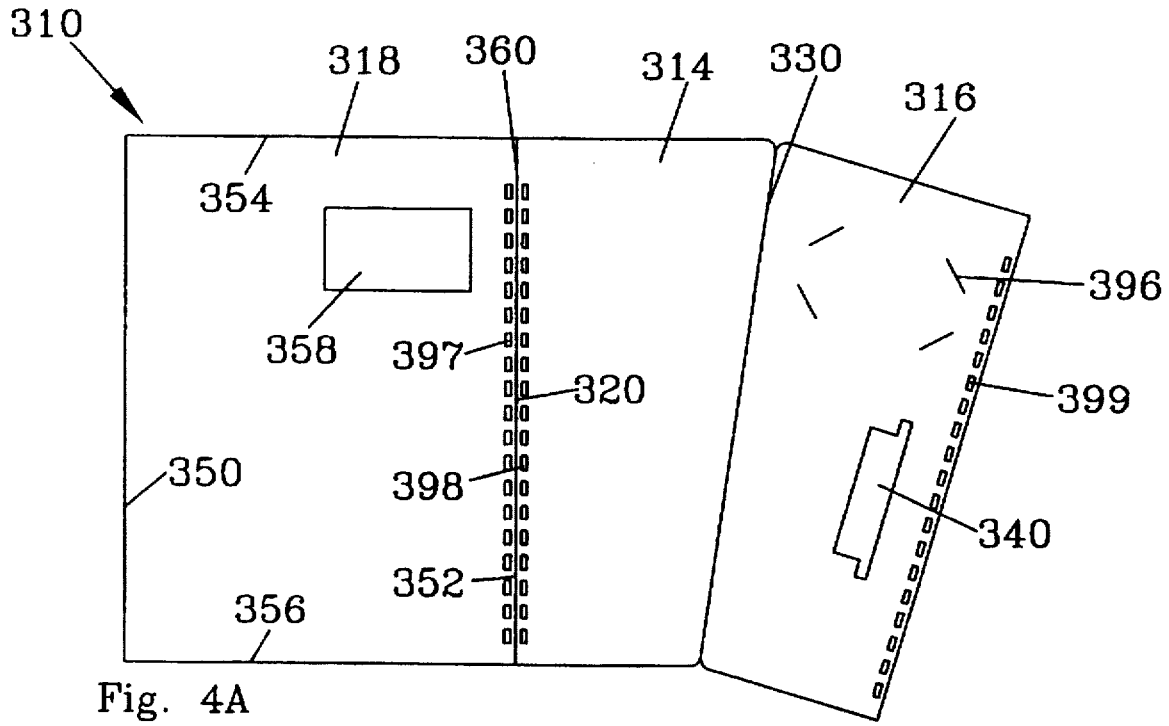
FIGS. 4A and 4B.
Figure 4B:
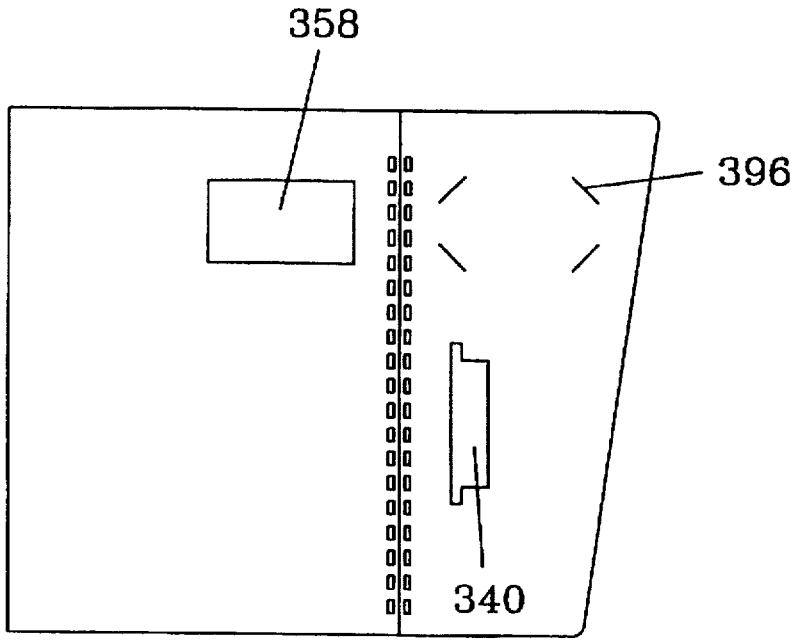

As shown in FIGS. 4A and 4B, the fourth preferred embodiment features a folio pocket system of the present invention with an integrated report or folio front cover. Otherwise, the fourth preferred embodiment is substantially the same as the first preferred embodiment. Accordingly, only the different features of the fourth preferred embodiment will be discussed below.

System 310 of the fourth preferred embodiment is comprised of a first backing sheet 314, a second carrier sheet 316 and a third report front cover sheet 318. Report front cover sheet 318 is preferably in a rectangular configuration. Report front cover sheet 318 has long lateral edges 350 and 352. Report front cover sheet 318 also has short upper edge 354 and short lower edge 356. Report front cover sheet 318 is formed integrally with first backing sheet 314. Specifically, lateral edge 352 of front cover sheet 318 is formed integrally with lateral edge 320 of first backing sheet 314 along a first common joining or fold line 360. Report front cover sheet 318 may also have small cutout sections 397 corresponding to small cutout sections 398 of first backing sheet 314 and small cutout sections 399 of second sheet 316. Report front cover sheet 318 may further have cutout window opening 358 therethrough. Cutout window opening 358 may be located such that a business card inserted into the four slits 396 of second sheet 316 remains visible when the system is assembled and front cover 318 is folded over the folio pocket assembly. Second carrier sheet 316 also has slit-like cutout opening 340 therein that forms the opening of the pocket. Otherwise, the remaining components and construction of the fourth preferred embodiment is substantially the same as the first preferred embodiment.

To assemble the system of the fourth preferred embodiment, second sheet 316 is folded over first backing sheet 314 along fold line 330. Next, front cover sheet 318 is folded over first backing sheet 314 and second sheet 316 (which are folded over one another). This system is then bound by any suitable means to the rest of a report cover system. In this manner, an integrated report front cover and folio pocket system is achieved. Furthermore, FIG. 4B provides a good example of how the binding of the overall report system at fold line 360 prevents the desired content from completely sliding out of the pocket, when the report system is bound and the front cover sheet is closed.

DESCRIPTION OF A FIFTH PREFERRED EMBODIMENT

Figure 5A:
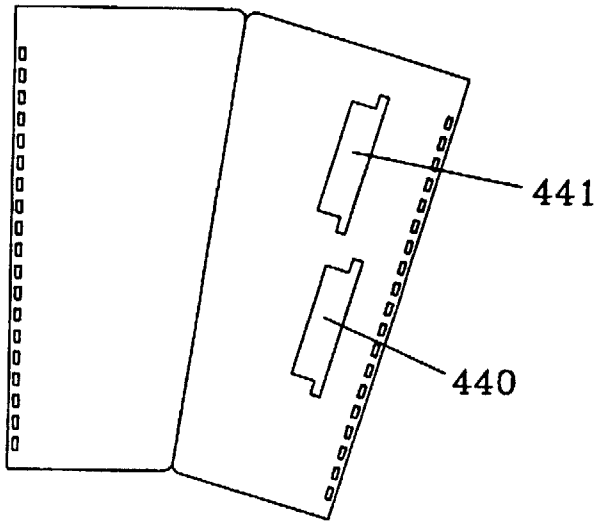
FIGS. 5A, 5B, and 5C.
Figure 5B:
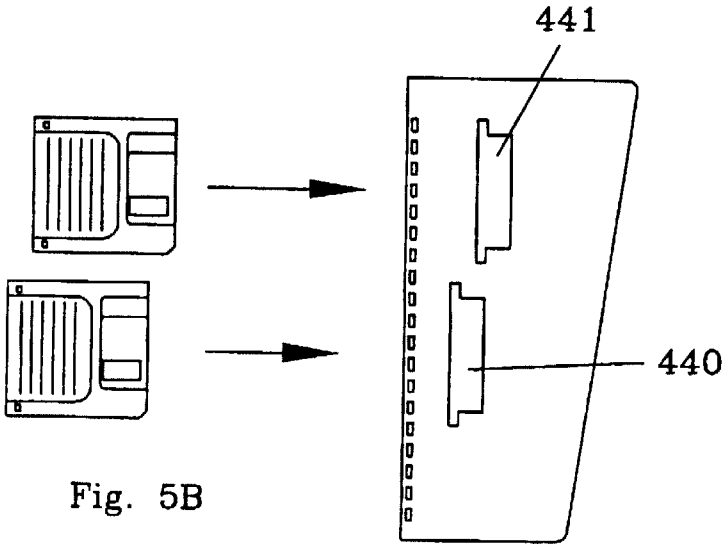
Figure 5C:
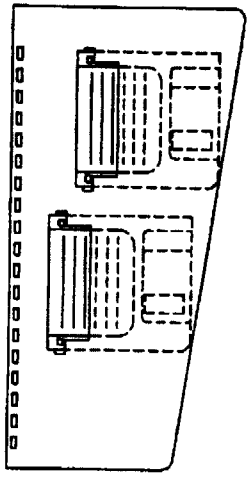

As shown in FIG. 5, a fifth preferred embodiment features a first pocket 440 and second pocket 441 for the insertion of supplemental materials. Otherwise, the fifth preferred embodiment is substantially the same as the first preferred embodiment. Accordingly, reference should be had to the description of the first preferred embodiment as such description will not be repeated herein.

DESCRIPTION OF A SIXTH PREFERRED EMBODIMENT

A sixth preferred embodiment includes a stopper sheet assembly designed to prevent inserted supplemental material from sliding out of the pocket created by the first backing sheet and the second carrier sheet with an opening at a cutout in the second carrier sheet. Otherwise, the sixth preferred embodiment is substantially the same as the first preferred embodiment. Accordingly, the new and different components and assembly of the sixth preferred embodiment will be discussed herein.

Figure 6:
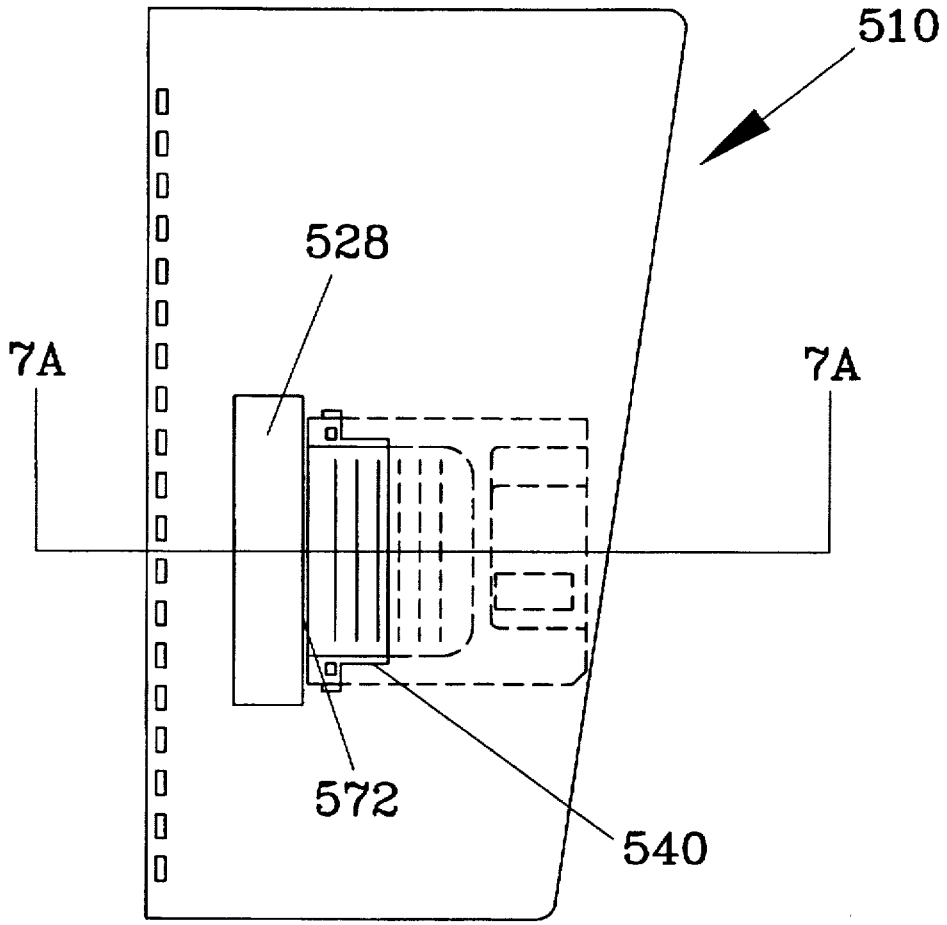
FIG. 6 is a front view of a sixth preferred embodiment, wherein a stopper assembly has been coupled to the second sheet.
Figure 7:
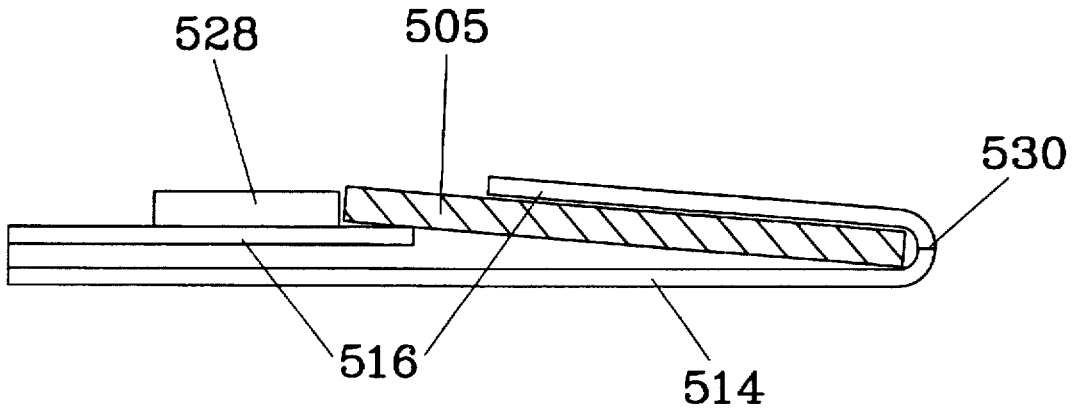
FIG. 7 is a cross-sectional view of a sixth preferred embodiment as taken along line 7A—7A of FIG. 6.

As shown in FIGS. 6 and 7, system 510 includes a stopper sheet assembly 528 adhesively coupled to the outer face of second carrier sheet 516. Stopper assembly has at least one edge 572 that is adapted to contact an exposed edge of inserted supplemental material 505. Stopper assembly may be comprised of one ply of material when the thickness of the stopper assembly is sufficient to effectively engage an edge or side of the inserted supplemental material. Alternatively, the stopper assembly can be constructed of multiple plys. Stopper assembly 528 is placed on second carrier sheet 516 such that stopper edge 572 prevents inserted material from sliding out of the pocket formed between first backing sheet 514 and second carrier sheet 516 with an opening at cutout opening 540. Specifically, in this sixth preferred embodiment, fold line 530 contacts one edge of the inserted material 505, while stopper edge 572 contacts the opposite edge of inserted material 505. In this manner, the system substantially prevents the inserted material from sliding out of the pocket in a horizontal direction. In use, the pliable nature of the materials used in the folio pocket system allows the user to manipulate the system to retrieve the inserted material.

DESCRIPTION OF A SEVENTH PREFERRED EMBODIMENT

A seventh preferred embodiment features a pocket cover flap, instead of a stopper assembly, that securely holds supplemental materials within the pocket of the present invention. Otherwise, the system of the seventh preferred embodiment is substantially the same as the first preferred embodiment.

Figure 8:
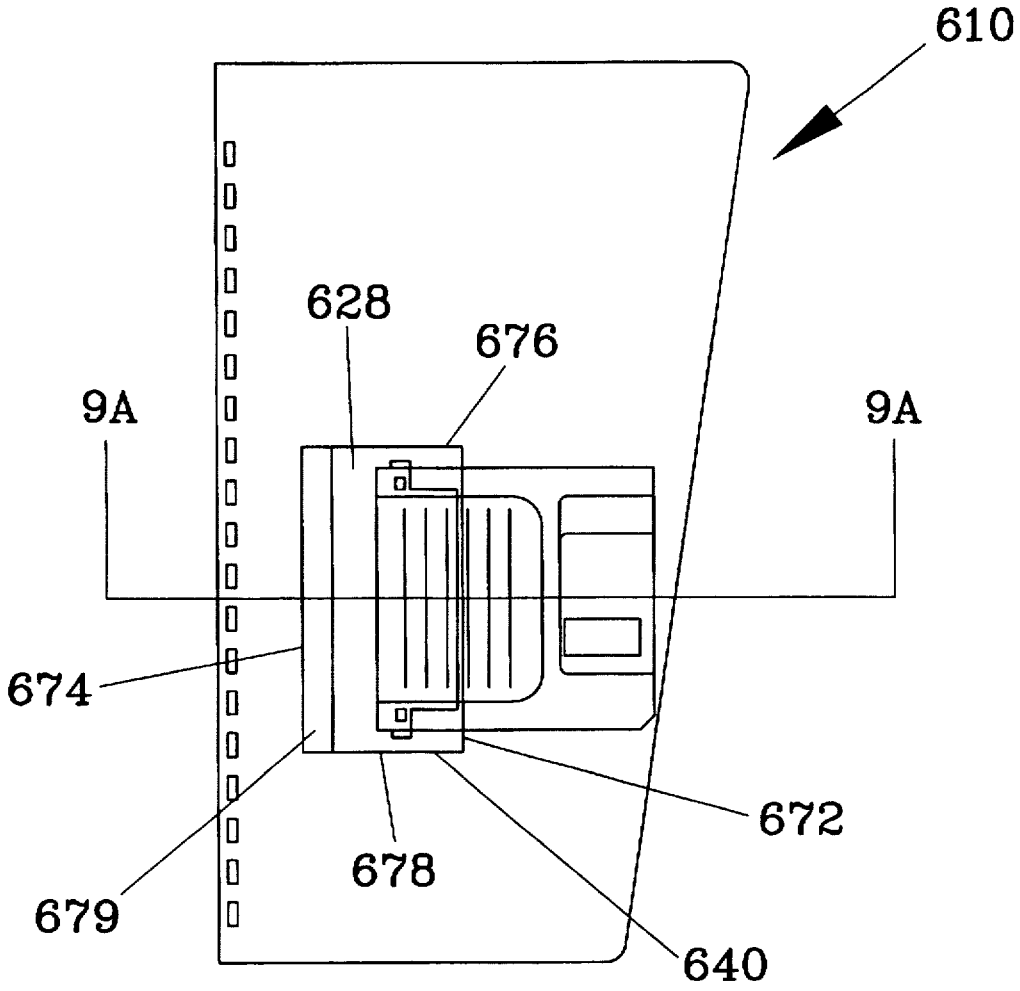
FIG. 8 is a front view of a seventh preferred embodiment, wherein a pocket cover flap has been attached to the second sheet.
Figure 9:
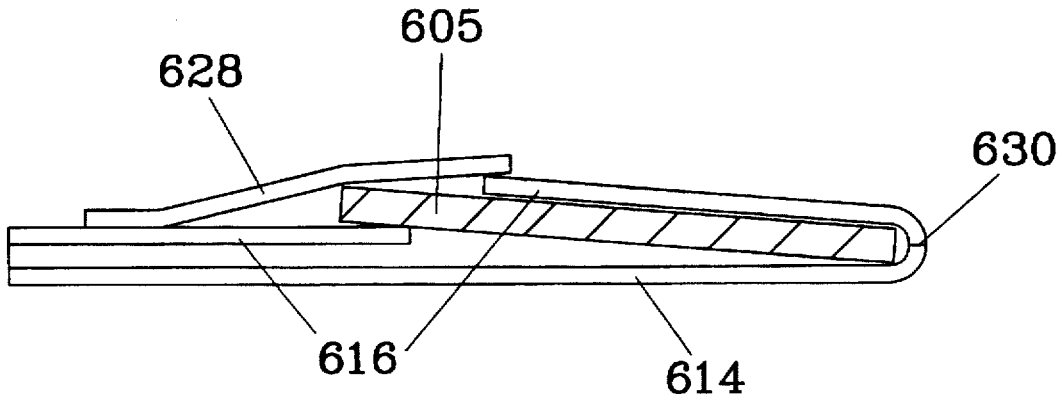
FIG. 9 is a cross-sectional view of a seventh preferred embodiment as taken along line 9A—9A of FIG. 8.

As shown in FIGS. 8 and 9, system 610 includes a pocket cover flap 628. Pocket cover flap 628 is comprised of at least one layer of material. In this embodiment, pocket cover flap 628 is essentially rectangular in configuration. Pocket cover flap 628 has lateral edges 672 and 674, an upper edge 676 and a lower edge 678. Adhesive 679 couples lateral edge 674 of pocket cover flap 628 to the outer face of second carrier sheet 616 such that cover flap 628 extends over cutout opening 640.

In use, the user folds pocket cover flap 628 back to uncover cutout opening 640. The user then inserts desired supplemental material into the pocket, as discussed in the first preferred embodiment. To securely hold the inserted content, 605 the user folds pocket cover flap 628 over the outer portion of the inserted content and cutout opening 640. Inserted supplemental material 605 is held in place, within the pocket formed by pocket cover flap 628, second carrier sheet 616, first backing sheet 614 and fold line 630.

SUMMARY

With respect to the above description, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact constructions and operations shown and described. Accordingly, all suitable modifications and equivalents which may be resorted to fall within the scope of the invention.

I claim:

1. A folio pocket system comprising:

first backing sheet, second carrier sheet, and preventer means, wherein said first backing sheet is joined to said second carrier sheet along a first common edge, wherein said first backing sheet includes binding means along an edge opposite to said first common edge into which said folio pocket system is bound, wherein said second carrier sheet includes binding means along an edge remote from said first sheet and corresponding to said binding means of said first sheet so as to create a pocket by and between said first backing sheet and said second carrier sheet when said second carrier sheet is folded along said first common edge and said first backing sheet and said second carrier sheet are bound, wherein said second carrier sheet has at least one slit-like cutout opening therethrough wherein said slit-like cutout opening defines a slit-like opening in said pocket and said first common edge defines an end of said pocket, wherein said slit-like cutout opening is oriented such that material inserted therein contacts said pocket end, and wherein said preventer means prevent materials inserted into said pocket through said slit-like cutout opening from sliding out of said pocket.

2. A folio pocket system of claim 1 wherein said preventer means include a cover sheet, and wherein said preventer means are formed by securely attaching said cover sheet to said first backing sheet and said second carrier sheet such that material inserted into said pocket through said slit-like cutout opening is prevented from sliding out of said pocket by said attached cover sheet, and further wherein said attachment is at least in the area of said first backing sheet or said second carrier sheet adjacent to said slit-like cutout opening.

3. A folio pocket system according to claim 2 wherein said cover sheet comprises a folio cover.

4. A folio pocket system of claim 1 wherein said preventer means comprise at least one stopper sheet assembly coupled to said second carrier sheet, wherein said stopper sheet assembly is positioned so as to prevent material inserted into said pocket through said slit-like cutout opening from sliding out of said pocket.

5. A folio pocket system of claim 1 wherein said preventer means comprise at least one pocket slit-like cutout opening cover flap coupled to said second carrier sheet, wherein said cover flap is positioned so as to prevent material inserted into said pocket through said slit-like cutout opening from sliding out of said pocket.

6. A folio pocket system of claim 1 wherein said slit-like cutout is substantially parallel to said pocket end.

7. A folio pocket system of claim 1 wherein said slit-like cutout is positioned such that material inserted into said pocket through said slit-like cutout opening contacts said pocket end, and wherein at least one edge of said slit-like cutout opening engages said inserted material.

8. A folio pocket system of claim 1 wherein said slit-like cutout opening is oriented at an angle of between zero to about forty-five degrees from said pocket end.

9. A folio pocket system of claim 1, wherein said first backing sheet is substantially the same size as the second carrier sheet.

10. A folio pocket system of claim 1 wherein said first backing sheet is integrally formed with said second carrier sheet along said first common edge.

11. A folio pocket system of claim 1 wherein said second sheet further includes means to secure a business card or other materials thereto.

12. A folio pocket system of claim 1 wherein said binding means comprise one of the following binding means: three holes along an edge of said first sheet arranged in a three-hole punch configuration; or small cutouts along an edge of said first sheet corresponding to a binder comb configuration.

13. A folio pocket system comprising:

a first backing sheet, a second carrier sheet, and a third cover sheet, wherein said first backing sheet and said second carrier sheet are joined at a first common edge, wherein said first backing and second carrier sheets each have respective second edges opposite to said first common edge, wherein said first backing and second cover sheets each have corresponding binding means alone said respective second edges, so as to create a pocket by and between said first backing sheet and said second carrier sheet when said sheets are bound at said respective second edges, wherein said second carrier sheet has at least one slit-like cutout opening therethrough wherein said slit-like cutout opening defines a slit-like opening in said pocket and said first common joined edge defines an end of said pocket, wherein said slit-like cutout opening is positioned substantially adjacent to said second edge and is oriented such that material inserted into said pocket through said slit-like cutout opening contacts said pocket end, and further wherein at least one edge of said slit-like cutout opening engages said inserted material, wherein the inner surface of said third cover sheet is in contact with the outer surface of said second carrier sheet when said folio system is in a closed position, wherein said third cover sheet has an edge that is at least partially common to said second edge of said first backing sheet, wherein said third cover sheet has binding means along said edge of said third cover sheet, said binding means corresponding to said binding means of said first backing and said second carrier sheets, and wherein said third cover sheet is securely attached to said first backing sheet and said second carrier sheet at said respective binding means of said first, second and third sheets, at least in the area adjacent to said slit-like cutout opening, such that material inserted into said pocket through said slit-like cutout opening is prevented from sliding out of said pocket by said attached third cover sheet.

14. A folio pocket system of claim 13 wherein said slit-like cutout is substantially parallel to said pocket end.

15. A folio pocket system of claim 13 wherein said slit-like cutout opening is oriented at an angle of between zero and about forty-five degrees from said pocket end.

16. A folio pocket system of claim 13 wherein said first backing sheet and said second carrier sheet are integrally formed and folded back on one another along said first common edge.

17. A folio pocket comprising:

a first backing sheet, a second carrier sheet, and preventer assembly means, wherein said first backing sheet and said second carrier sheet each have a first common edge, and further wherein said first backing sheet and said second carrier sheet are attached to one another at said first common edge, wherein said first backing sheet includes binding means along a second edge opposite to said first common edge into which said folio pocket system is bound or otherwise secured, wherein said second carrier sheet includes binding means along a second edge opposite said first common edge and corresponding to said binding means of said first sheet so as to create a pocket by and between said first backing sheet and said second carrier sheet, wherein said second carrier sheet has at least one slit-like cutout opening therethrough wherein said slit-like cutout opening defines a slit-like opening in said pocket and said first joined common edge defines an end of said pocket, wherein said slit-like cutout opening is oriented such that material inserted therein contacts said pocket end, and preventer assembly means coupled to said second carrier sheet such that material inserted into said pocket through said slit-like cutout opening is prevented from sliding out.

18. A folio slit pocket system of claim 17 wherein said preventer assembly means is selected from at least one of the following: (1) stopper sheet means, and (2) slit-like cutout opening cover flap.

19. A folio slit pocket system of one-piece construction comprising:

a first backing sheet, a second carrier sheet, and a third cover sheet, wherein said first backing sheet and said second carrier sheet are integrally formed and foldable along a first common fold line, wherein said first backing sheet and said third cover sheet are integrally formed and foldable along a second common fold line opposite to said first common fold line between said first backing sheet and said second carrier sheet, wherein said first backing sheet and said second carrier sheet are folded along said first common fold line, and said first backing sheet and said third cover sheet are folded along said second common fold line such that said second carrier sheet is sandwiched between said first backing sheet and said third cover sheet, wherein said first backing sheet and said third cover sheet each have binding means substantially along said second common fold line and wherein said second carrier sheet has binding means along an edge opposite said first common fold line and corresponding to said binding mean of said first backing sheet and said third cover sheet, thereby creating an assembly having a pocket by and between said first backing sheet and said second carrier sheet, and a cover sheet over said second carrier sheet when said first, second and third sheets are bound together at said respective binding means, wherein said second carrier sheet has at least one slit-like cutout opening therethrough wherein said slit-like cutout opening defines a slit-like opening in said pocket and said first common fold line defines an end of said pocket, wherein said slit-like cutout opening is positioned substantially adjacent to said second common fold line and is oriented such that material inserted into said pocket through said slit-like cutout opening contacts said pocket end, and further wherein at least one edge of said slit-like cutout opening engages said inserted material.

wherein said first backing sheet, said second carrier sheet and said third cover sheet are securely attached, at least in the area adjacent to said slit-like cutout opening at said respective binding means of said first, second and third sheets, such that material inserted into said pocket through said slit-like cutout opening is prevented from sliding out of said pocket.

20. The folio pocket system of claim 19 wherein said third cover sheet further includes a cutout window therethrough, through which materials attached to said second carrier sheet or inserted into said pocket are visible.

* * * * *

UNITED STATES PATENT AND TRADEMARK OFFICE

CERTIFICATE OF CORRECTION

PATENT NO. : 5,895,165

DATED : April 20, 1999

INVENTOR(S) : Larry Leibe Mogelonsky

It is certified that error appears in the above-indentified patent and that said Letters Patent is hereby corrected as shown below:

Column 2, line 4: please insert - a - after "so as to form".
Column 2, line 34: delete "singe" and insert thereof - single -.
Column 6, line 19: insert - carrier - before "sheet 16".
Column 7, line 26: insert - 116 - before "is preferably".
Column 8, line 56: delete "FIG.5" and insert thereof -FIG.5A -.
Column 9, line 12: insert - 528 - after "Stopper assembly".
Column 12, line 62: delete "mean" and insert thereof - means -.

Signed and Sealed this

Twelfth Day of October, 1999

*Attest:*

Q. TODD DICKINSON

*Attesting Officer*

*Acting Commissioner of Patents and Trademarks*